United States Patent [19]

Hale

[11] 4,066,057

[45] Jan. 3, 1978

[54] CYLINDER HEAD MOUNTING APPARATUS FOR INTERNAL COMBUSTION ENGINES

[75] Inventor: David Jerry Hale, Pickett, Wis.

[73] Assignee: Brunswick Corporation, Skokie, Ill.

[21] Appl. No.: 610,320

[22] Filed: Sept. 4, 1975

[51] Int. Cl.[2] ..... F02F 1/36

[52] U.S. Cl. ..... 123/193 CH; 123/41.72; 123/41.74; 123/41.82 R; 123/193 H

[58] Field of Search ..... 123/193 H, 193 CH, 41.31, 123/41.72, 41.74, 41.82

[56] References Cited

U.S. PATENT DOCUMENTS

| | | | |
|---|---|---|---|
| 1,127,783 | 2/1915 | Leimer | 123/193 CH |
| 1,260,859 | 3/1918 | Bie | 123/193 CH |
| 1,468,465 | 9/1923 | Erickson | 123/193 CH |
| 1,529,059 | 3/1925 | Frey | 123/193 CH |
| 1,606,790 | 11/1926 | Horning | 123/193 CH |
| 1,862,970 | 6/1932 | Raymond | 123/193 CH |
| 1,928,411 | 9/1933 | Cross | 123/193 CH |
| 2,191,050 | 2/1940 | Trice | 123/193 CH |
| 2,964,030 | 12/1960 | Werner | 123/193 CH |
| 3,379,179 | 4/1968 | Mantzel | 123/193 CH |
| 3,628,427 | 12/1971 | Bailey | 123/193 CH |

*Primary Examiner*—Ronald H. Lazarus
*Assistant Examiner*—Daniel J. O'Connor
*Attorney, Agent, or Firm*—Andrus, Sceales, Starke & Sawall

[57] ABSTRACT

A V-engine includes angularly oriented cylinder banks with an outer enclosing rectangular cooling jacket wall and outwardly opening cylinders closed by an outer cylinder head. Bolt attaching lugs are integrally formed on the exterior of the cylinder walls within the cooling chamber and are spaced from the jacket wall to maintain a continuous cooling passageway. The head is bolted to the cylinder block at such lugs. The inner and outer vertical edges of the head are beveled with the outer edge reducing the overall width and inner edge increasing the spacing between the cylinder banks.

8 Claims, 3 Drawing Figures

T
T
P
P
1
2
3
6
7
8
9
11
12
13
13'
14
14
15
16
17
19
21
22
24
25
27
27
28
29
30
31
32
32
33
34
35
35
36
36
37
37

CYLINDER HEAD MOUNTING APPARATUS FOR INTERNAL COMBUSTION ENGINES

BACKGROUND OF THE INVENTION

The present invention relates to a cylinder head mounting apparatus for internal combustion engines and particularly for V-engines.

Internal combustion engines for outboard motors and the like include one or more cylinder units, each of which includes a cylindrical portion and an outer-head closure portion. Higher horsepower engines employ a plurality of cylinder units arranged as in-line or V-shaped blocks. In both types, the engine is mounted with a plurality of in-line cylinders arranged in a vertical stacked relation. The engine is generally water cooled with an outer water cooling jacket wall integrally cast about the upper portion of the cylinders to define a cooling passageway and chamber about the several cylinders. The head portion is bolted or otherwise secured to the cooling jacket wall with a suitable gasket therebetween to effectively seal the cylinders and the cooling chamber. Generally the head portion will also be water cooled and may conveniently be formed of an inner head and an outer cooling jacket cover secured to the outer surface of the head.

In the V-engines the angular orientation of the vertical aligned cylinder banks develops a reasonably wide engine, particularly where a ninty-degree V is used. Particularly when applied to an outboard motor with the vertical mounting of the engine, the width of the engine becomes significant not only from a constructional standpoint but from an aesthetic consideration. This is particularly true as higher horsepower of outboard motors are developed, generally requiring increased cylinders in each bank. For example although a ninty-degree V-6 engine could for example be designed, the overall height and width is increased significantly with additional cylinders and creates a bulky appearance. Although the engine width can be minimized with a sixty-degree engine block, the available space for a manifold assembly and the like becomes constricted and the width of the engine remains significantly greater than for an in-line engine.

SUMMARY OF THE PRESENT INVENTION

The present invention is particularly directed to an improved head mounting means for internal combustion engines and particularly for V-engines to permit narrowing of the overall width of the engine while maintaining reliable efficient cooling and engine operation. The mounting means of this invention is simple and readily incorporated in the conventional method of producing V-engines.

Generally, in accordance with the present invention, the cylinder unit is formed in a cylinder block with an outer enclosing cooling jacket wall and closed by an outerhead unit which is interconnected to the cylinder block by attachment means, such as the usual bolt means, located within the water cooling chamber. The inward placement of the attachment means, permits the removal or beveling of the outer side edge of the head thereby permitting significant reduction in the width.

More particularly, in accordance with a particularly practical and unique embodiment of the present invention, bolt attaching lug-members are formed on the exterior of the cylinder walls. The lugs are spaced from the jacket wall which maintains the desired cooling passageway. The head is secured to the cylinder block by suitable bolt means which securely attach the head in sealing engagement to the cylinder unit and to the cooling jacket. The inner and outer vertical edges of the head are beveled with the outer edge reducing the overall width and the inner edge increasing the spacing between the cylinder banks for an exhaust manifold system. The outer head cooling jacket or cover is bolted or otherwise secured to the reduced outer face of the head.

In a particularly practical implementation of the invention, the outer cooling jacket is a generally rectangular outer wall with intermediate partial walls located adjacent cylinders. Thus each of the cylinders are generally enclosed by a generally square wall and cooling chamber. The bolt lugs are integrally formed on the outer cylinder and four corners of the chamber at which ample space is available for developing a strong cast lug, without interferring with the flow of water cooling through the cylinder cooling chambers.

The present invention thus provides a simple reliable and relatively inexpensive means for minimizing the overall width of the engines and is particularly adapted to a sixty-degree V-6 engine for mounting as the power head of an outboard motor.

BRIEF DESCRIPTION OF THE DRAWINGS

The drawings furnished herewith illustrates a preferred construction of the present invention in which the above advantages and features are clearly disclosed as well as others which will be readily understood from the following description.

In the drawings.

DESCRIPTION OF THE ILLUSTRATED EMBODIMENT

Figure 1:
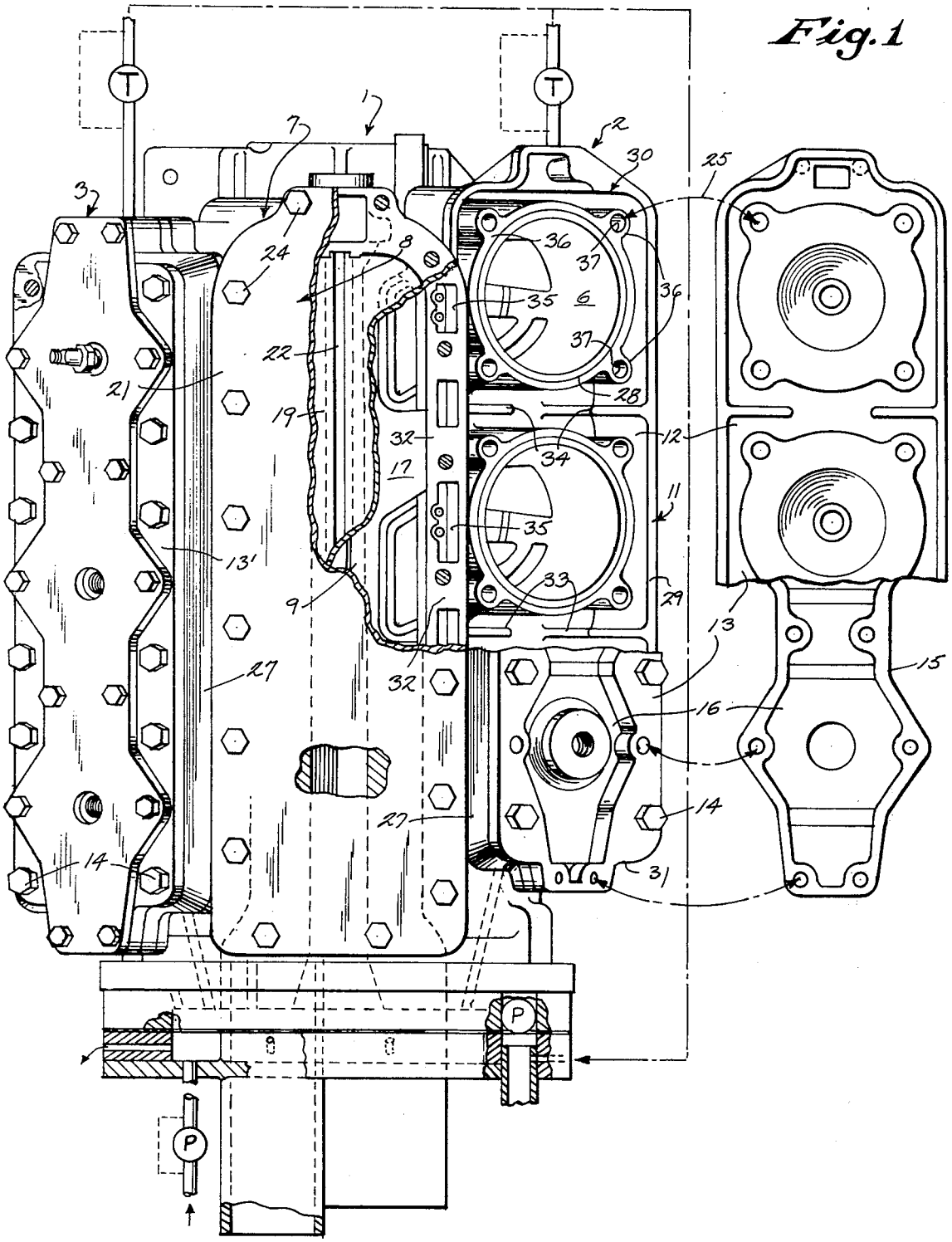
FIG. 1 is a front elevational view of a sixty-degree V-6 engine with parts broken away and sectioned, and with one of the heads partially removed to show certain inner details of construction.
Figure 2:
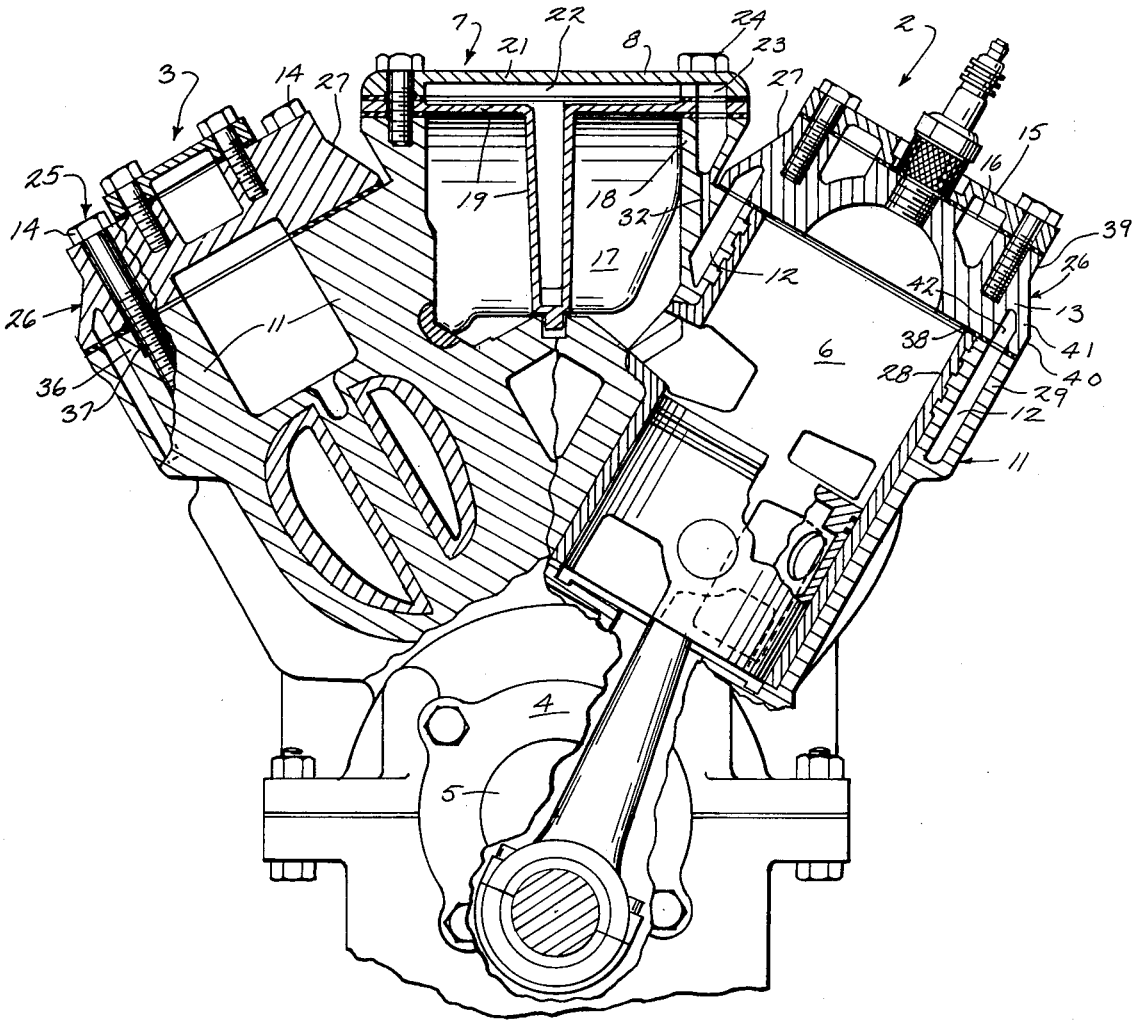
FIG. 2 is horizontal section taken generally on line 2 — 2 of FIG. 1.
Figure 3:
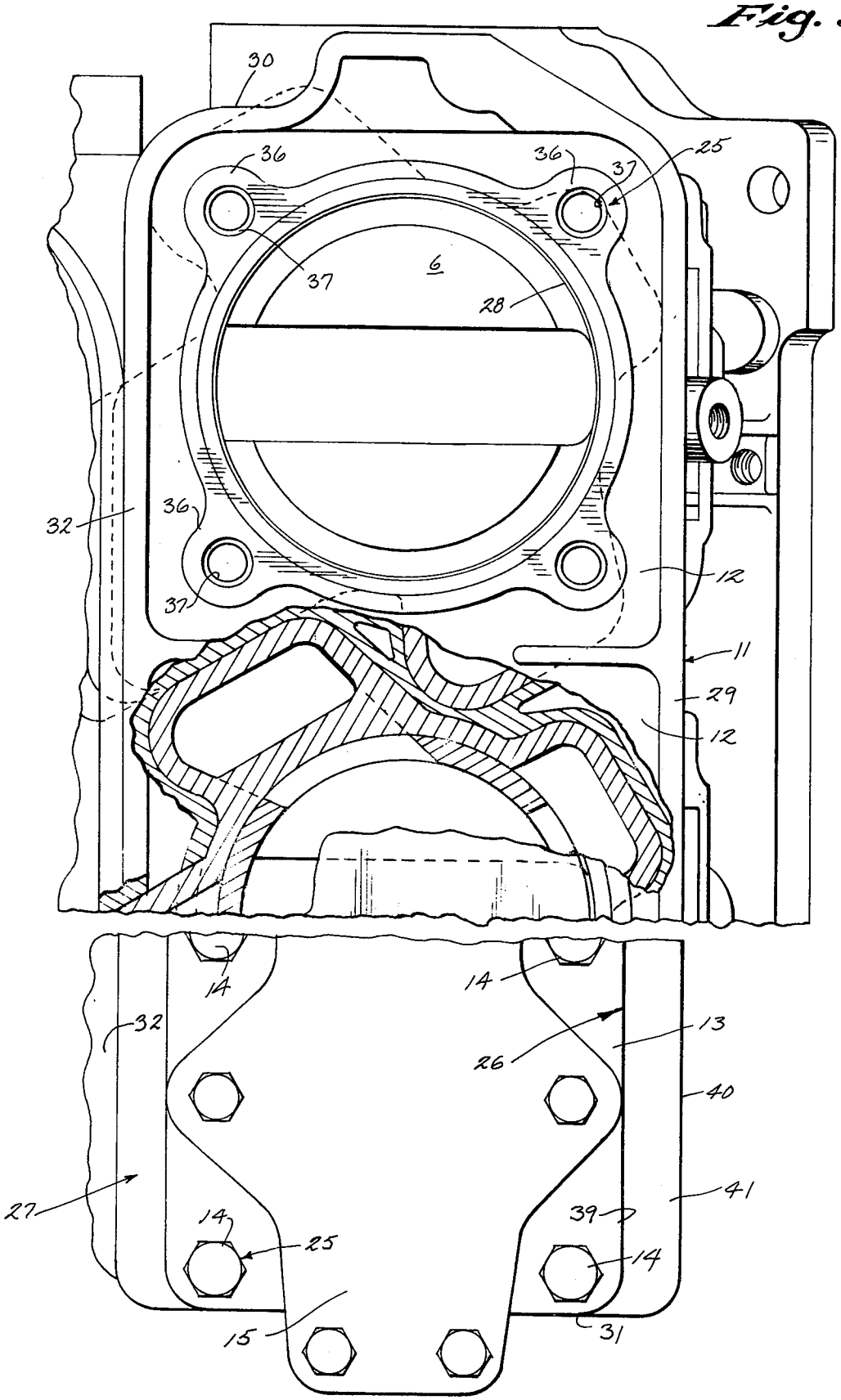
FIG. 3 is a fragmentary portion of a cylinder bank showing one of the cylinders with the head removed to more clearly illustrate the inner detail of the head mounting construction.

Referring to the drawings and particularly FIGS. 1 and 2, sixty-degree V-6 engine 1 for incorporation as the power head of an outboard motor is illustrated. The V-6 engine 1 generally includes a pair of cylinder banks 2 and 3 which are angularly oriented with respect to a crankcase 4 within which a suitable crankshaft 5 is rotatably mounted. The banks 2 and 3 define an inclusive angle of sixty-degrees in the illustrated embodiment of the invention and each of the cylinder banks 2 and 3 are similarly constructed with three vertical in-line cylinder unit 6.

An exhaust manifold assembly 7 is located between the cylinder banks 2 and 3 having an outer cover assembly. The engine 1 is conventionally cast with a cylinder block 9 within which cylinder portions 10 of each cylinder unit 6 is formed. An outer cooling jacket wall 11 encircles the in-line cylinder units 6 in each bank 2 and 3 and defines a cooling passageway or chamber 12 about the cylinder portions 10 for cooling thereof. The outer end of the cylinder portion 10 of the cooling chamber 12 is closed by an inner head 13 which is secured to the cylinder block 9 by suitable clamping bolts 14. An outer head cover 15 is secured to the head 13 to form a head cooling chamber 16. The manifold assembly 7 located between the engine banks 2 and 3 includes an exhaust chamber 17 cast within block 9 and an outer mounting flange 18 to receive the manifold cover assembly 8. In the illustrated embodiment of the invention, the assembly 8 includes a generally T-shaped inner cover 19 having an inwardly projecting stem defining separate exhaust passageways for each bank 2 and 3 of cylinders. An outer dish-shaped coolant cover 21 forms a water cooling jacket 22 for the manifold cover assembly. As illustrated, the jacket 22 is connected by interconnecting passageways 23 in the mounting flange 18 to the cylinder cooling jacket or chamber 12 defined by the adjacent outer cooling jacket wall 11. The cover assembly 8 is bolted to the mounting flange 18 by suitable bolts 24.

The other details of the engine construction including the exhausting and porting means maybe of any suitable construction. The present invention is particularly directed to the unique and novel attachement means for connecting of the cylinder head portion to the cylinder block. Consequently, no further description of the engine is given other than as necessary to clearly explain the illustrated embodiment of the present invention.

Generally, as shown in the drawings, the head attachment means 25 for connecting of the head 13 to the cylinder block 9 is located inwardly of the cooling jacket wall 11 and in particular within the cooling chamber 12 and inwardly spaced relation to the cooling jacket wall 11. This location permits removal of the outer vertical side edge of the cylinder head 9, as shown at 26 in FIGS. 1 and 2, and provides significant reduction in the overall width of the engine 1. The inner edges may also be removed as at 27 to increase the available space for the manifold cover assembly 8 or the like.

In accordance with the illustrated embodiment of the invention, the interconnecting or attachment means for each of the cylinder banks 2 and 3 is similarly constructed and bank 2 is described. The block 9 is cast with the outer cylinder jacket wall 11 encircling the outer cylindrical poritions 28 of the cylinder units 6 within which the firing of the engine occurs. Wall 11 generally includes an outer generally flat wall 29 extended parallel and in outwardly spaced relation past each of three individual cylinder portions 28. The outer wall 29 is connected to the top and bottom parallel walls 30 and 31 which extend inwardly normal thereto and are connected to an inner side wall 32, common to the exhaust chamber 17. The wall 32 is parallel to outer wall 29 and spaced outwardly from the cylinder units 6. The jacket wall 11 thus defines a continuous chamber 12 about all of the three cylinder units 6, with small partial separating walls 33 located between each of the adjacent cylinder units 6. The walls 33 are spaced slightly from each other to define an opening 34 between the chamber about the adjacent cylinders.

The cooling water is introduced into the cylinder chamber 12 through a suitable passageway 35 in the manifold flange 18 and the common wall 32. The cooling water may flow from the manifold cooling chamber 22, passageway 35 into the cooling chamber 12 and then upwardly into the cylinder head assembly.

In accordance with the illustrated embodiment of the present invention, the cylinder block encasing the cylindrical portion 28 is provided with head receiving bolt lugs 36, each of which is provided with threaded bolt receiving openings 37. The lugs 36 are located immediately adjacent to the four corners of the square chamber defined by the several jacket walls and are spaced inwardly from such jacket walls to permit continuous flow through the water cooling chamber.

The head 13 is secured to the cylinder block 9 by suitable clamping bolts 14 which extend through the head 13 and into the threaded openings 37. The head 13 extends outwardly over the water chamber into abutting engagement with upper sealing surface of the water jacket wall 11, with the usual gasket 38 disposed therebetween. Applicant has found that the inward location of the clamping bolts 14 maintains a highly effective and reliable seal and support of the cylinder head 13 while maintaining efficient cooling of the engine.

The head 13 is previously described has the outer edges removed as at 26 and 27 to reduce the overall width and increase the free space between banks 2 and 3.

In the illustrated embodiment, the removed section defines an inwardly spaced edge wall 39 parallel to the outermost side wall 40 adjacent the cylinder block 9 and joined by a beveled or inclined wall 41. The portion of head 13 aligned with the outer and inner walls 29 and 32 is recessed as at 42 and form an outward extension of cooling chamber 12. The flat outer wall 41 and beveled wall accommodates the extension. The beveling of the outer side edges significantly reduces the width of the engine. Thus in a sixty degree V-engine, the engine was reduced by a couple of inches.

Further, the beveling of the inner side edges provides additional space within which the flange of the manifold chamber walls can be enlarged to accommodate the water cooling connecting openings. The outer cover of the manifold chamber can thus be conveniently nested within the two cylinder banks.

The head 13 is completed by the outer water cooling cover 15 secured to the outer flat wall as by suitable bolts. The cover 15 is generally an inverted recessed member having a configuration to enclose the portions of the head 13 interconnecting passageways to maintain a continuous flow of water over the cylinder head 13 to maintain efficient cooling thereof.

The present invention provides a relatively simple and inexpensive means of mass producing the engines particularly adapted for outboard motors and the like.

Various modes of carrying out the invention are contemplated as being within the scope of the following claims particularly pointing out and distinctly claiming the subject matter which is regarded as the invention.

I claim:

1. In an internal combustion engine having a V-block defining a pair of cylinder banks with a plurality of cylinders arranged as in-line cylinders in each bank, each of said cylinders having an outer sidewall and being closed by a separate cylinder head, each of said cylinder banks having an outer cooling jacket wall encircling said cylinders in the bank and spaced from the cylinder sidewalls for defining a separate cooling chamber about said cylinders in each bank, said separate cylinder head overlying each bank and closing the cylinders and the cooling chamber, said separate head providing the only closure of said cylinder and said cooling chamber, head attachment means secured to said sidewalls for securing of the head to the cylinder bank within the corresponding cooling chamber in inwardly spaced relation to the corresponding jacket wall whereby each of the cooling chambers extends around said head attachment means and provides coolant flow around the head attachment means, said heads having the outer side edges beveled to reduce the width of the engine.

2. In the internal combustion engine of claim 1 wherein said head attachment means includes protruding support walls integrally formed with the cylinder walls and spaced from the jacket wall to maintain coolant flow around the cylinder and attachment means.

3. In the internal combustion engine of claim 2 wherein each of said support walls includes threaded openings to receive threaded bolt means.

4. In the internal combustion engine of claim 2 wherein each of said cooling jacket walls is a generally rectangular wall symmetrically located about said plurality of cylinders, said protruding support walls being located in alignment with the corners of the cooling jacket wall.

5. In the internal combustion engine of claim 2 wherein said cylinders in each bank are spaced from each other and each of said cooling jacket walls includes intermediate walls located between adjacent cylinders to form a generally square cooling chamber, said protruding support walls being located at each of the corners of each of the cooling chambers.

6. In the internal combustion engine of claim 1 wherein each of said heads is a generally rectangular head having side edges formed with parallel top and bottom portions with the top portion located inwardly of the bottom portion and joined by a planar wall portion.

7. In the internal combustion engine of claim 1 including a manifold exhaust chamber located between said banks, and an exhaust cover secured to the exhaust chamber between the two cylinder banks, said heads have the inner side edges beveled to provide maximum space for the manifold cover.

8. In the engine of claim 7 wherein said exhaust chamber includes an inner wall portion partially in common with said cooling jacket wall and an outer wall portion adjacent said head cover and including cooling water passageways coupling the exhaust cover to the cylinder cooling chambers.

* * * * *